United States Patent [19]

Swinehart

[11] 4,113,999

[45] Sep. 12, 1978

[54] HAND HELD COMMUNICATIONS MICROPHONE

[75] Inventor: Frank Swinehart, Waseca, Minn.

[73] Assignee: Warren A. Sturm, Minneapolis, Minn.

[21] Appl. No.: 633,870

[22] Filed: Nov. 20, 1975

[51] Int. Cl.[2] ..... H04R 1/02

[52] U.S. Cl. ..... 179/179; 179/180; 179/184

[58] Field of Search ..... 179/179, 184, 187, 180, 179/178, 182 R, 146 R, 121 R, 110 A

[56] References Cited

U.S. PATENT DOCUMENTS

| | | | |
|---|---|---|---|
| 2,556,168 | 6/1951 | Cragg et al. | 179/184 |
| 2,709,723 | 5/1955 | Breisch et al. | 179/179 |
| 2,718,563 | 9/1955 | Nicholides | 179/146 R |
| 2,891,131 | 6/1959 | Runge et al. | 179/179 X |
| 3,548,121 | 12/1970 | Gorike et al. | 179/184 |
| 3,651,286 | 3/1972 | Gorike et al. | 179/180 |
| 3,660,602 | 5/1972 | Thompson | 179/110 A X |
| 3,751,600 | 8/1973 | Reichard, Jr. | 179/100 L |

FOREIGN PATENT DOCUMENTS

| | | | |
|---|---|---|---|
| 425,186 | 3/1935 | United Kingdom | 179/179 |

*Primary Examiner*—Thomas W. Brown

*Attorney, Agent, or Firm*—Warren A. Sturm; Hugh D. Jaeger

[57] ABSTRACT

A microphone of the hand held type used in portable or remote radio communications systems in which improved resistance to shock, wet environmental conditions is achieved by using a resilient mounting means for a receiver disposed inside a hollow housing which includes a stop for limiting motion of the receiver in the resilient mounting means and through the use of a loosely mounted water impervious membrane over the active side of the receiver and further disposing an open cell, foamed plastic element over the outside of the plastic membrane.

1 Claim, 5 Drawing Figures

10
11
12
13
14
15
16
17
18
19
20
21
22
3
4

HAND HELD COMMUNICATIONS MICROPHONE

BACKGROUND OF THE INVENTION

This invention relates to improvements in communications-type microphones, and particularly in the type that is generally characterized as "hand held" as might be used with mobile or portable radio communications equipment.

SUMMARY OF THE INVENTION

As will be seen, the features of my invention are directed toward eliminating or minimizing the effects of certain environmental characteristics that may be encountered in the use of portable and mobile radio communications equipment. A hand held microphone constructed in accordance with the principles of my invention substantially eliminates the effect and/or continuing effect of large quantities of water that may find their way into the aperture over which a receiver is disposed by providing a water impervious membrane that is loosely disposed between the receiver and the outer portions of the housing and disposing an element of open celled foamed plastic material located between the water impervious membrane and the aperture 13 of front member 11. By combination of these two features, any water that approaches the receiver is repelled by the impervious membrane and such water as may collect within the open celled material, which also functions as a blast filter, may be easily removed by inverting the microphone housing so that the aperture is disposed downwardly and gently tapping the microphone at which point the water will freely be ejected from the open celled foam plastic element. Further, through the conjoint operation of the resilient mounting means for the receiver cartridge disposed within the housing, together with a mechanical stop to limit any mechanical movement, displacement and undue damage to the receiver cartridge is virtually eliminated.

BRIEF DESCRIPTION OF THE DRAWINGS

FIG. 1 is a front elevational view of a hand held communications microphone;

DESCRIPTION OF THE PREFERRED EMBODIMENT

Figures 2, 3, 7:
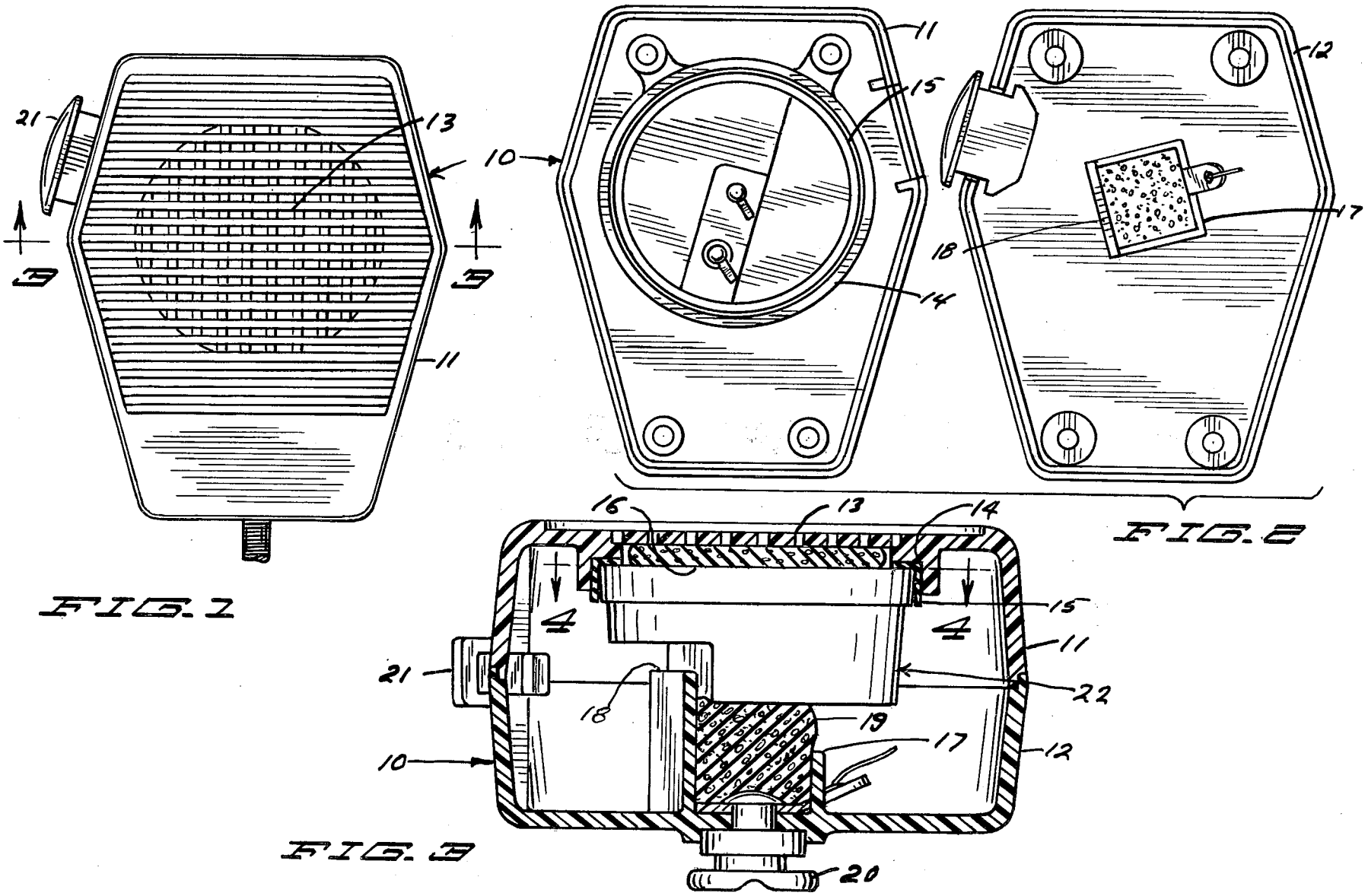
FIG. 2 is a view of each of the two halves of the housing of the microphone looking from the inside, the left end of FIG. 2 being the front half and the right side of FIG. 2 being the rear half.
FIG. 3 is a sectional view taken along section lines 3—3 of FIG. 1.

Referring to the drawings, there is shown a hand held communications microphone, indicated generally by reference character 10. Microphone 10 is comprised of front and back members 11 and 12, respectively, which are adapted to be assembled into a complete unit and held together by suitable means (not shown). Front member 11 includes an aperture 13 that is shown in the form of an open lattice of bar-shaped members through which sound may freely travel. The inside periphery of aperture 13 is formed to provide a circular recess 14 which is configured to receive a resilient gasket member 15 and to accommodate a disk of open celled foam plastic material, such as "polycoustic" marketed by the Scott Paper Company. Back member 12 includes a receptacle 17 having a raised portion at one peripheral portion identified by reference character 18. Recess 17 is filled with foamed or plastic resilient material indicated generally by reference character 19 to a height determined by the relative dimensions of the inside of microphone 10 and the thickness dimension of a receiver to be mounted therein. A mounting button 20 is shown disposed extending outwardly of back member 12 and is used in cooperation with a well-known mounting bracket for hanging the microphone in proximity to the communications equipment with which it is associated. A push-to-talk button 21 is shown disposed extending through the housing of the microphone and is utilized in connection with appropriate switching mechanisms to control the operation of the communications equipment through suitable means (not shown).

Figure 4:
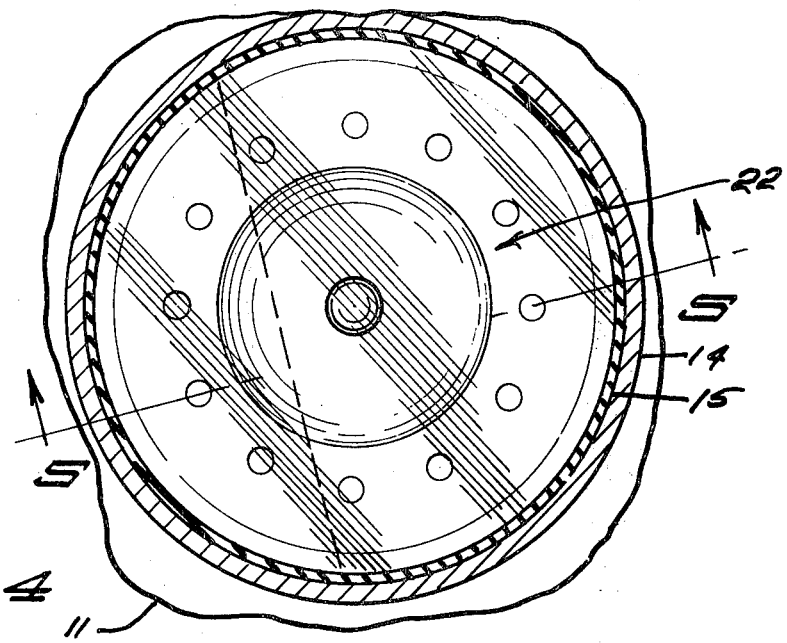
FIG. 4 is a front fragmentary view of a portion of FIG. 3 taken along section line 4—4.
Figure 5:
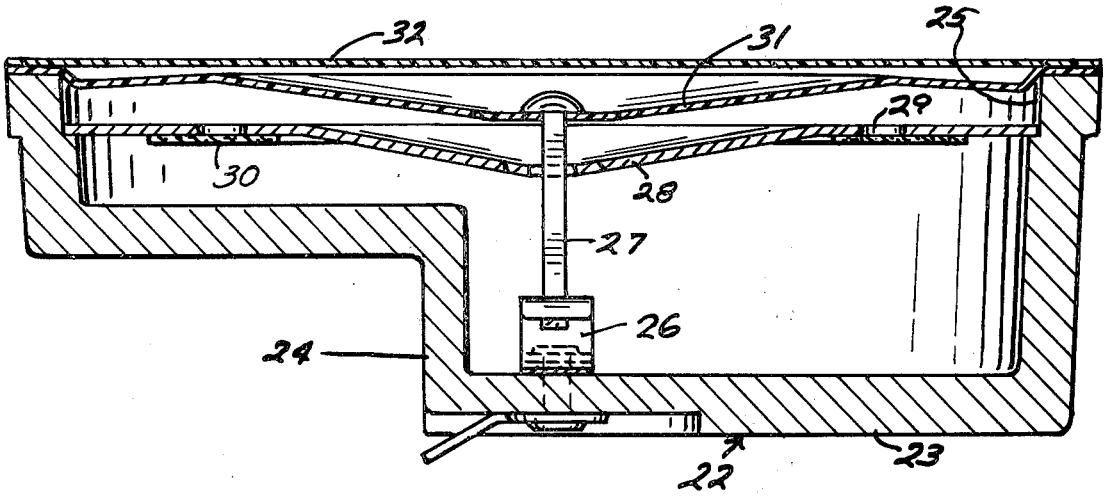
FIG. 5 is a sectional view of a receiver cartridge as is used in the illustrated embodiment of FIGS. 1, 2, 3 and 4, taken along section line 5—5 in FIG. 4.

A receiver indicated generally by reference character 22 is shown in detail in FIGS. 4 and 5. Receiver 22 includes a case 23 of generally cylindrical configuration having an open top 25 and a step in the rear or bottom portion indicated by reference character 24. A suitable transducing element is indicated generally by reference character 26 which may be ceramic and reference is specifically made to my U.S. Pat. No. 3,710,040 for further details concerning same. A drive pin 27 is shown connected to the center of a plastic diaphragm 31 that is disposed on top of the open end of case 23 and held thereon by suitable fastening means, such as epoxy plastic.

A damping element 30 having a plurality of apertures 29 is shown disposed underneath diaphragm 31 and is further provided with a ring of suitable porous damping material indicated by reference character 30. A water impervious membrane 32 is disposed over the top of diaphragm 31. Membrane 32 may be loosely disposed thereon and may be held in place by suitable means, such as epoxy plastic.

OPERATION

Under the normal environmental conditions of operation of hand held microphones, the microphone is subject to large forces due to being dropped or the like and it may be seen that the cooperating relationship of gasket 15 and resilient pad 19, together with stop member 18 and the inwardly extending recess 14, serve to retain receiver 22 in operating disposition under such conditions; it may further be observed that under conditions of water entering aperture 13 in microphone 10, the water will be repelled by membrane 32 and may be held within the open cells of element 16. Should the liquid accumulate in sufficient quantities to impair the usefulness of the microphone, it may simply be removed by tapping the microphone gently with the microphone in a generally inverted position.

I claim:

1. The combination in a microphone comprising:

a hollow housing, top and bottom major surfaces in said housing;

an aperture on said top surface for receiving sound energy and transmitting sound energy into said housing;

receiver means internal to said housing and in communication with said aperture comprising a case having an open top, a ceramic transducing means internal to said case, a plastic diaphragm supported in said case and connected to said transducing means, a damping element having a plurality of apertures disposed underneath said diaphragm, said plurality of apertures of said damping element covered by porous damping material;

open cellular foam plastic material disposed between said apertures and said receiver means;

a moisture impervious material loosely disposed between said open cellular material and said receiver means and means sealing said membrane over a top of said plastic diaphragm;

a stop means on said bottom surface for limiting maximum displacement of said receiver means disposed between said surfaces; and, resilient mounting rubber gasket means disposed about said aperture surrounding a top of said receiver means and resilient mounting means opposite said aperture on said bottom surface being disposed within said stop means.

* * * * *